US006905651B2

(12) United States Patent
Johansson et al.

(10) Patent No.: US 6,905,651 B2
(45) Date of Patent: Jun. 14, 2005

(54) FERRITIC STAINLESS STEEL ALLOY AND ITS USE AS A SUBSTRATE FOR CATALYTIC CONVERTERS

(75) Inventors: Simon Johansson, Sandviken (SE); Bo Rogberg, Gävle (SE)

(73) Assignee: Sandvik AB, Sandviken (SE)

( * ) Notice: Subject to any disclaimer, the term of this patent is extended or adjusted under 35 U.S.C. 154(b) by 169 days.

(21) Appl. No.: 10/290,468

(22) Filed: Nov. 8, 2002

(65) Prior Publication Data

US 2003/0119667 A1 Jun. 26, 2003

Related U.S. Application Data

(63) Continuation of application No. 09/102,369, filed on Jun. 23, 1998, now abandoned.

(30) Foreign Application Priority Data

Jun. 27, 1997 (SE) ..... 9702478

(51) Int. Cl.[7] ..... C22C 33/00; C22C 33/04

(52) U.S. Cl. ..... 420/71; 420/40; 420/79; 420/83; 420/129; 502/439; 502/355

(58) Field of Search ..... 502/439, 242, 502/316, 320, 336, 355; 420/40, 79, 83, 71, 129

(56) References Cited

U.S. PATENT DOCUMENTS

| | | | | |
|---|---|---|---|---|
| 4,414,023 A | | 11/1983 | Aggen et al. | |
| 4,661,169 A | | 4/1987 | Aggen et al. | |
| 4,859,649 A | | 8/1989 | Bohnke et al. | |
| 4,870,046 A | | 9/1989 | Yamanaka et al. | |
| 4,904,540 A | * | 2/1990 | Ishii et al. | 428/606 |
| 4,969,960 A | * | 11/1990 | Lehnert et al. | 148/284 |
| 4,985,388 A | * | 1/1991 | Whittenberger | 502/439 |
| 5,045,404 A | | 9/1991 | Ohmura et al. | |
| 5,160,390 A | * | 11/1992 | Yukumoto et al. | 148/325 |
| 5,228,932 A | | 7/1993 | Shimizu et al. | |
| 5,405,460 A | | 4/1995 | Yamanaka et al. | |
| 5,578,265 A | | 11/1996 | Ericson et al. | |

FOREIGN PATENT DOCUMENTS

| | | |
|---|---|---|
| DE | 39 11 619 A1 | 10/1990 |
| DE | 36 21 569 A1 | 1/1998 |
| EP | 0 497 992 A1 | 8/1992 |

* cited by examiner

*Primary Examiner*—Christina Johnson
(74) *Attorney, Agent, or Firm*—Burns, Doane, Swecker & Mathis, L.L.P.

(57) ABSTRACT

A ferritic stainless steel alloy useful as a substrate for catalytic converter material consists of, by weight: 15–21% Cr, 8–12% Al, 0.01–0.09% Ce, 0.02–0.1% total of REM, and possible minor amounts of further elements, other than the ones mentioned, the balance being Fe with normally occurring impurities. These alloys have managed to combine a high content of Al with a good hot and cold workability.

2 Claims, 1 Drawing Sheet

FERRITIC STAINLESS STEEL ALLOY AND ITS USE AS A SUBSTRATE FOR CATALYTIC CONVERTERS

This application is a continuation of application Ser. No. 09/102,369, filed on Jun. 23, 1998 now abandoned.

BACKGROUND OF THE INVENTION

The present invention relates to ferritic stainless steel alloys. More particularly, the invention relates to an iron-chromium-aluminum alloy having additions of rare earth metals (hereafter referred to as "REM").

The rare earth metals constitute a group of 15 chemically related elements in group IIIB of the Periodic Table (lanthanide series), namely, lanthanum, cerium, praseodymium, neodymium, promethium, samarium, europium, gadolinium, terbium, dysprosium, holmium, erbium, thulium, ytterbium and lutetium. The primary commercial form of mixed rare earth metals is the so-called misch metal, prepared by the electrolysis of fused rare earth chloride mixtures.

In general, it is well-known that Fe—Cr—Al ferritic stainless steel is a material suitable for applications requiring high oxidation resistance, such as the catalyst substrate or carrier of an exhaust gas purifying device for automobiles.

U.S. Pat. No. 5,578,265 discloses a ferritic stainless steel alloy which can be used as a catalytic substrate. The alloy consists essentially of (by weight): 19–21% Cr, 4.5–6% Al, 0.01–0.03% Ce, with a total REM of 0.02–0.05%, >0.015% total Mg+Ca, and balance of Fe plus normally occurring impurities. The steel can be manufactured by producing a melt of the desired analysis, casting, hot rolling and cold rolling to thin sheets.

U.S. Pat. No. 4,414,023 discloses an iron-chromium-aluminum alloy with a REM addition, which alloy is resistant to thermal cyclic oxidation and hot workable. A preferred aluminum content between 3 to 8% is disclosed. Further, it is stated that there is a marked decline in the ability to texturize the aluminum oxide surface at aluminum contents above 8%, i.e., to form alumina whiskers.

Previous works have claimed that foil production by conventional rolling methods is impossible at Al contents higher than 5–8% Al. The further addition of Al is said to be very detrimental to the ductility and toughness of the material. In U.S. Pat. No. 5,045,404, it is disclosed that when the Al content is more than 6.5%, not only is the toughness of a hot rolled strip greatly lowered to thereby impair the processability, but also the thermal expansion coefficient becomes extremely high and leads to a serious amount of thermal fatigue due to the repeated heating and cooling effects when used as a catalyst carrier.

U.S. Pat. No. 5,228,932 describes a Fe—Cr—Al alloy having excellent oxidation resistance and high temperature brittleness resistance. The alloy consists of 10–28% Cr, 1–10% Al, additions of B, La and Zr and the balance Fe. At an Al content higher than 6%, it is disclosed that foil of this alloy cannot be produced by conventional methods. In this case, an alternative manufacturing method is employed. Al is added to the surface of the alloy by sputtering, cladding, etc. After this, the foil is homogenized by a heat treatment.

In view of the above prior art, there has been a prejudice against increasing the Al concentration to levels above 8% by weight, although this is desirable due to improved oxidation resistance when higher Al levels are present. The main reason for this reluctance to increasing the concentration of Al has resided in the assumption that an increase of the level of Al deteriorates the warm and cold workability such as warm and cold rolling to thin sheets.

OBJECTS AND SUMMARY OF THE INVENTION

It is an object of this invention to avoid or alleviate the problems of the prior art.

It is further an object of this invention to provide improved oxidation resistance of ferritic stainless steel alloys while maintaining a good hot and cold workability, particularly in view of the use of the alloy as a catalyst carrier in the form of thin foils.

In one aspect of the invention there is provided a ferritic stainless steel alloy useful as a substrate for catalytic converter material comprising in percent by weight: 15–21% Cr, 8–12% Al, 0.01–0.09% Ce, 0.02–0.1% total of REM, the balance essentially being Fe and the catalyst substrate for an exhaust gas purifying device for automobiles made of that alloy.

In another aspect of the invention there is provided a catalyst for exhaust gases from automobiles, wherein the substrate for the catalytically active material is made of a thin foil of ferritic stainless steel alloy.

BRIEF DESCRIPTION OF THE DRAWINGS

The FIGURE shows the effect of aluminum content on the high temperature properties of Fe—Cr—Al alloys.

DETAILED DESCRIPTION OF THE PREFERRED EMBODIMENTS OF THE INVENTION

Figure 1:
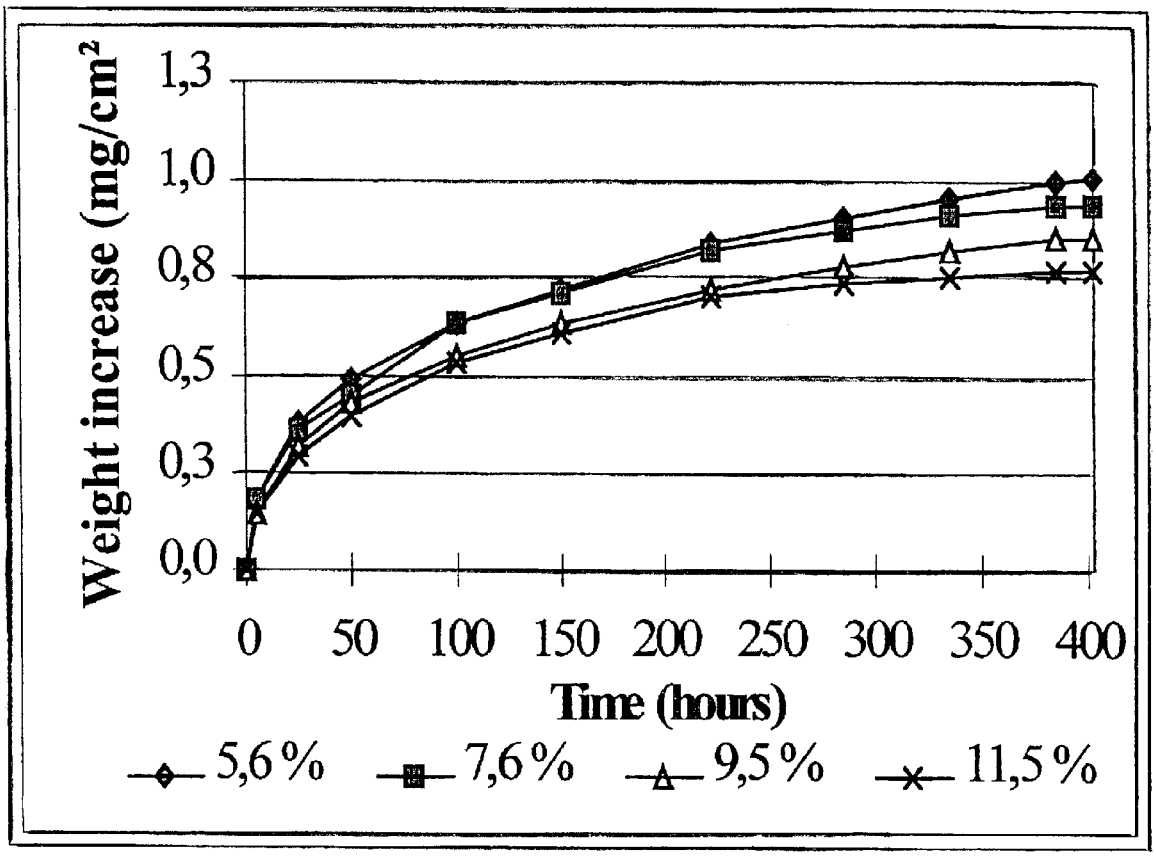

The present invention has managed to solve the problem of the prior art by formulating a new class of ferritic stainless steel alloys which can be successfully submitted to extensive warm and cold rolling in spite of a high Al content (>8.0% and <12% by weight of aluminum).

Thus, the present invention provides a ferritic stainless steel alloy useful for strip steel used in exhaust gas catalytic converters, comprising (in weight %): 15–21% Cr, 8–12% Al, 0.01–0.09% Ce, 0.02–0.1% total of REM (including Ce), and possible minor amounts of each further element (e.g., less than a total of 4%), other than the ones mentioned above, the balance being Fe with normally occurring impurities. These impurities are present in amounts of 1% maximum total impurities and either partly coincide with the possible minor amounts of further elements or are other elements than said possible minor amounts of further elements.

Said possible minor amounts of further elements may, e.g., be the following: ≦0.015% Ca; ≦0.3% Ti preferably ≦0.2% Ti, most preferably ≦0.015% Ti; ≦0.5% Zr, preferably ≦0.2% Zr, most preferably ≦0.1% Zr; ≦0.5% Ni; ≦0.5% Mo; ≦0.3% V, preferably ≦0.1% V; and ≦0.3% Nb, preferably ≦0.1% Nb.

According to preferred embodiments of the invention, the alloy can contain: a total V, Ti, Nb and/or Zr of 0.05–1.0%, 0.03–0.1% V, 19–21% Cr, 0.2–0.4% Mn and/or 0.1–0.4% Si.

Further, the alloy according to the invention preferably contains 0.01 to 0.03% by weight of Ce and 0.02 to 0.05 of REM. Again, the Ce content is included in the REM content.

Depending on the raw materials used, a number of impurities may occur in the alloy according to the invention. For these impurities, the following maximal contents should suitably be observed: ≦0.02% C, preferably ≦0.015% C; ≦0.025% Mg, preferably ≦0.020% Mg, most preferably ≦0.015% Mg; ≦0.1% N, preferably ≦0.025% N, most preferably ≦0.015% N; ≦0.02 P; ≦0.005% S; ≦0.1% W; ≦0.1% Co; ≦0.1% Cu; and ≦0.1% Sn. The steel can be manufactured by producing a melt of the desired analysis, casting, hot rolling and cold rolling to thin sheets.

In the FIGURE, the tests have been made on samples in the form of 1 mm thick sheet-metal.

The present invention provides a ferrite chromium aluminum strip steel useful for manufacture of monoliths for catalytic converters. The steel contains a higher aluminum content than conventional substrate materials in order to prolong the service life and raise the maximum service temperature of the catalytic converter. The steel also includes additives of REM which improve the adhesion of the surface oxide and consequently prevent scaling.

A metal-based monolith offers many advantages in comparison with a ceramic one. For instance, the metal-based monolith provides better thermal conductivity, shorter light-off time and less risk of overheating.

For this kind of application, there is an advantage in using the material in the shape of a very thin foil, typically with a thickness of 20 to 50 $\mu$m. The thickness of the foil is reduced to minimize the resistance for the exhaust gas flowing through the catalytic converter, but also to enhance the combustion efficiency. In order to enhance the efficiency of the combustion, work has been done to raise the service temperature of the catalytic converter. This has created a need for even more oxidation resistant substrate materials.

It is well-known that the oxidation resistance of heat-resistant Fe—Cr—Al alloys is due to the formation of a compact, continuous layer of aluminum oxide, ($\alpha$-$Al_2O_3$) on the surface of the alloy. The main factor for determining the lifetime of a catalytic converter is the amount of Al in the material. During the use of the catalytic converter, the Al atoms in the substrate material migrate to the surface of the alloy by diffusion, to form aluminum oxide. This leads to a reduction of the Al content in the substrate material. The formation of ($\alpha$-$Al_2O_3$) proceeds to a point where the Al content in the substrate material is too low to form $\alpha$-$Al_2O_3$. At this point, so-called break-away oxidation occurs, by rapid oxidation of Fe and Cr. The formation of Fe and Cr oxides leads to spalling of the protective layer of $\alpha$-$Al_2O_3$ and the oxidation accelerates even more.

The increase of the service temperature of the catalytic converter leads to accelerated oxidation kinetics. The Al atoms in the substrate material are consumed faster. This means a shorter service life for the catalytic converter.

The present invention has been developed in order to improve the oxidation resistance of the substrate material and thereby meet the demands for future catalytic converters. This is done by raising the Al content of the conventional alloy. The improvement of oxidation resistance is obtained together with an excellent warm and cold workability.

Oxidation properties of the steel according to the invention are shown in the FIGURE. The percentages defined in the FIGURE refer to contents of Al. The graph shows the weight gain as a function of the holding time at 1100° C. The graph clearly demonstrates the positive effect of a higher Al content on the oxidation properties. As mentioned above, the tests were made on samples in the form of 1 mm thick sheet-metal. As may be clearly seen in this graph, the weight increase due to oxidation was considerably smaller for the two alloys according to the invention, i.e., the two ones with Al contents of 9.5 and 11.5% b.w., respectively. The complete analyses of these two alloys correspond to heat Nos. 4 and 5, respectively, in Table 1. The "5,6" and "7,6" alloys in the FIGURE relate to heat Nos. 8 and 9, respectively, in Table 1. The lower weight increase, i.e., the lower Al consumption, together with the higher Al content, results in a longer service life of the catalytic converter.

The steel according to the invention can be manufactured by producing a melt of the desired analysis, casting, hot rolling and cold rolling to thin sheets. The composition preferably includes the weight percentages as defined above.

Examples of the of alloys in accordance with the invention are set forth in the following Table 1.

| Heat | According to the invention | | | | | Prior art | | | |
|---|---|---|---|---|---|---|---|---|---|
| No. | 1 | 2 | 3 | 4 | 5 | 6 | 7 | 8 | 9 |
| C | 0.009 | 0.009 | 0.009 | 0.013 | 0.011 | 0.008 | 0.019 | 0.014 | 0.012 |
| Si | 0.11 | 0.1 | 0.07 | 0.18 | 0.17 | 0.07 | 0.34 | 0.2 | 0.18 |
| Mn | 0.09 | 0.09 | 0.07 | 0.21 | 0.21 | 0.08 | 0.32 | 0.27 | 0.21 |
| P | 0.008 | 0.009 | 0.008 | 0.015 | 0.013 | 0.009 | 0.009 | 0.015 | 0.012 |
| S (ppm) | 19 | 25 | 29 | 11 | 8 | 12 | <10 | 7 | 9 |
| Cr | 20.83 | 19.98 | 20.81 | 20.5 | 20.4 | 21.53 | 20.33 | 20.8 | 20.7 |
| Ni | 0.15 | 0.13 | 0.14 | 0.23 | 0.23 | 0.14 | 0.32 | 0.27 | 0.23 |
| Mo | <0.01 | <0.01 | <0.01 | 0.01 | 0.01 | <0.01 | 0.02 | <0.01 | 0.01 |
| Co | 0.023 | 0.023 | 0.026 | 0.017 | 0.016 | 0.027 | 0.027 | 0.017 | 0.017 |
| V | 0.009 | 0.011 | 0.013 | 0.039 | 0.039 | 0.013 | 0.04 | 0.041 | 0.037 |
| Ti | 0.008 | 0.007 | <0.005 | <0.03 | <0.03 | <0.005 | 0.006 | <0.005 | <0.03 |
| Cu | — | 0.031 | 0 | 0.015 | 0.015 | — | — | 0.023 | 0.016 |
| Al | 8.9 | 8.5 | 8.8 | 9.5 | 11.5 | 6.3 | 5.2 | 5.6 | 7.6 |
| Nb | <0.01 | <0.01 | <0.01 | <0.02 | <0.02 | <0.01 | <0.01 | <0.01 | <0.02 |
| Zr | <0.005 | <0.005 | <0.005 | <0.005 | <0.005 | <0.005 | <0.005 | <0.005 | <0.005 |
| N | 0.009 | 0.019 | 0.024 | 0.006 | 0.003 | 0.018 | 0.005 | 0.015 | 0.011 |
| Ce | 0.01 | 0.012 | 0.01 | 0.021 | 0.02 | 0.028 | 0.024 | 0.014 | 0.014 |
| Mg | 0.001 | 0.001 | 0.001 | <0.001 | <0.001 | 0.001 | 0.016 | <0.001 | <0.001 |
| La | — | — | — | 0.011 | 0.011 | — | — | 0.008 | 0.008 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a thin foil from a ferritic stainless steel alloy, the method comprising:

(i) forming a melt of the alloy with a composition comprising 19–21% Cr, 9–12% Al, 0.02–0.1% total of Ce plus additional amounts of other REM, the balance essentially being Fe;

(ii) casting the melt to form an ingot; and (iii) hot and cold rolling the ingot to an extent sufficient to produce a foil having a thickness on the order of 20 to 50 $\mu$m.

2. The method of claim 1, wherein the alloy contains 9% to 11.5% Al.

* * * * *